US008434250B2

(12) United States Patent
Epp

(10) Patent No.: US 8,434,250 B2
(45) Date of Patent: May 7, 2013

(54) SYSTEM AND METHOD FOR SELECTING COLOR AND DESIGN COMBINATIONS

(76) Inventor: Loreen Epp, Centerport, NY (US)

( * ) Notice: Subject to any disclaimer, the term of this patent is extended or adjusted under 35 U.S.C. 154(b) by 0 days.

(21) Appl. No.: 13/423,033

(22) Filed: Mar. 16, 2012

(65) Prior Publication Data

US 2012/0260544 A1 Oct. 18, 2012

Related U.S. Application Data

(60) Provisional application No. 61/465,149, filed on Mar. 16, 2011.

(51) Int. Cl.
*G09F 11/04* (2006.01)

(52) U.S. Cl.
USPC ..... 40/495; 434/78

(58) Field of Classification Search ..... 40/495; 434/78, 101
See application file for complete search history.

(56) References Cited

U.S. PATENT DOCUMENTS 1,202,586 A * 10/1916 Rindskopf ..... 434/78
1,483,529 A 2/1924 Tanner
1,832,750 A * 11/1931 Stephens ..... 434/78
1,871,078 A 8/1932 Nash
2,196,397 A 4/1940 Mcdonald
2,237,165 A 4/1941 Scheuer
2,512,181 A 6/1950 Wood
2,858,624 A 11/1958 Bowman
2,938,281 A 5/1960 Blanc
3,120,065 A 2/1964 Joseph
3,277,591 A * 10/1966 Rutkofsky ..... 434/78
4,112,594 A 9/1978 Impastato
4,211,016 A 7/1980 Eldar
4,399,353 A 8/1983 Adkins et al.
4,594,070 A 6/1986 Stoddard
4,973,253 A 11/1990 Shook et al.
4,992,050 A 2/1991 Edwards
5,803,739 A * 9/1998 Hitchcock ..... 434/78
6,122,391 A 9/2000 Ringland et al.
6,139,325 A * 10/2000 Tracy et al. ..... 434/104
6,270,123 B1 8/2001 Spangler
6,421,125 B1 7/2002 Tarumoto (Continued)

FOREIGN PATENT DOCUMENTS

JP 59065848 4/1984

OTHER PUBLICATIONS

Color Wheel for Quilters, 18 pages from Internet Jul. 28, 2009 http://softexpressions.com/software/notions/colorwheel.html.

*Primary Examiner* — Gary Hoge
(74) *Attorney, Agent, or Firm* — Leason Ellis LLP

(57) ABSTRACT

A system for presenting color and design combinations is provided. The system includes first substrate having at least two sections. Each section of the first substrate includes visual representations of physical items representative of a particular style category such that the style category of one section is different from the style category of another section. Each section of the first substrate includes at least one transparent area. The system also includes second substrate having at least two sections. Each section of the second substrate includes at least two colors representative of a particular color category such that the color category of one second substrate section is different from the color category of another second substrate section. The first substrate overlays the second substrate such that colors of one of the second substrate sections can be viewed through the transparent area of one of the first substrate sections.

9 Claims, 7 Drawing Sheets

U.S. PATENT DOCUMENTS

| | | | |
|---|---|---|---|
| 7,057,728 | B2 | 6/2006 | Takada et al. |
| 7,180,524 | B1 | 2/2007 | Axelrod |
| 7,561,735 | B2 | 7/2009 | Levin et al. |
| 2002/0184232 | A1 | 12/2002 | Menner et al. |
| 2005/0100210 | A1 | 5/2005 | Rice et al. |
| 2008/0299521 | A1 | 12/2008 | Taylor et al. |

* cited by examiner

SYSTEM AND METHOD FOR SELECTING COLOR AND DESIGN COMBINATIONS

CROSS-REFERENCE TO RELATED APPLICATIONS

This application claims the benefit of U.S. patent application Ser. No. 61/465,149, filed Mar. 16, 2011, which is hereby incorporated by reference in its entirety.

FIELD OF THE INVENTION

The present invention concerns a system and method for assisting a user in selecting colors and designs. More particularly, the invention concerns a system and method that assists a user in selecting color and design combinations.

BACKGROUND

Typical color wheels have been provided as a way for a user to view a number of different colors together on a wheel. However, the colors in such a basic wheel are not grouped and arranged such that multiple colors from a single style category are shown together on the same or arranged in groupings.

In addition, while color wheels have been provided with transparent windows to view samples (such as a piece of fabric viewed through the window in relation to the colors of the color wheel) these color wheels do not permit a user to view multiple design items grouped together by style categories in various combinations with multiple colors grouped together by style categories. The present invention solves this and other problems.

SUMMARY OF INVENTION

In accordance to one aspect of the invention, a system for presenting color and design combinations is provided. The system includes a first substrate having at least two sections, each first substrate section including at least one transparent area and visual representations of physical items representative of a particular style category. The style category of each first substrate section differs from the style category of another first substrate section. A second substrate having at least two sections is also included. Each second substrate section includes at least two colors representative of a particular color category. The color category of each second substrate section differs from the color category of another second substrate section. A support maintains the first and second substrate in spatial relationship with the first substrate overlying the second substrate. The first and second substrates are movably positionable with respect to each other from a first position in which one of the second substrate sections can be viewed through the transparent area of one of the first substrate sections and second position in which a different one of the second substrate sections can be viewed through the transparent area of the same one of the first substrate sections.

In accordance with a further aspect, the system includes a third substrate having a number of sections equal to the number of colors in each of the second substrate sections. Each third substrate section includes a single color that is the same color as a respective color of one of the second substrate sections such that a single third substrate includes all the colors of a single second substrate section The third substrate is interposed between the first and second substrates.

In another aspect, the first and second substrates are wheel shaped.

In a further aspect, the physical items are room furnishings.

In yet a further aspect, the style categories of the first substrate correspond to the color categories of the second substrate.

In yet a further still aspect, first substrate includes indicia to identify the style category of each of the first substrate sections.

In accordance with another aspect, second substrate includes indicia to identify the color category of each of the second substrate sections.

In a further aspect, visual demarcations separate the sections of each of the first and second substrates.

In another further aspect, a color panel having a color that is the same as one of the colors of the second substrate wherein the color panel is interposed between the first and second substrates.

DESCRIPTION OF THE DRAWING FIGURES

Figure 5A:
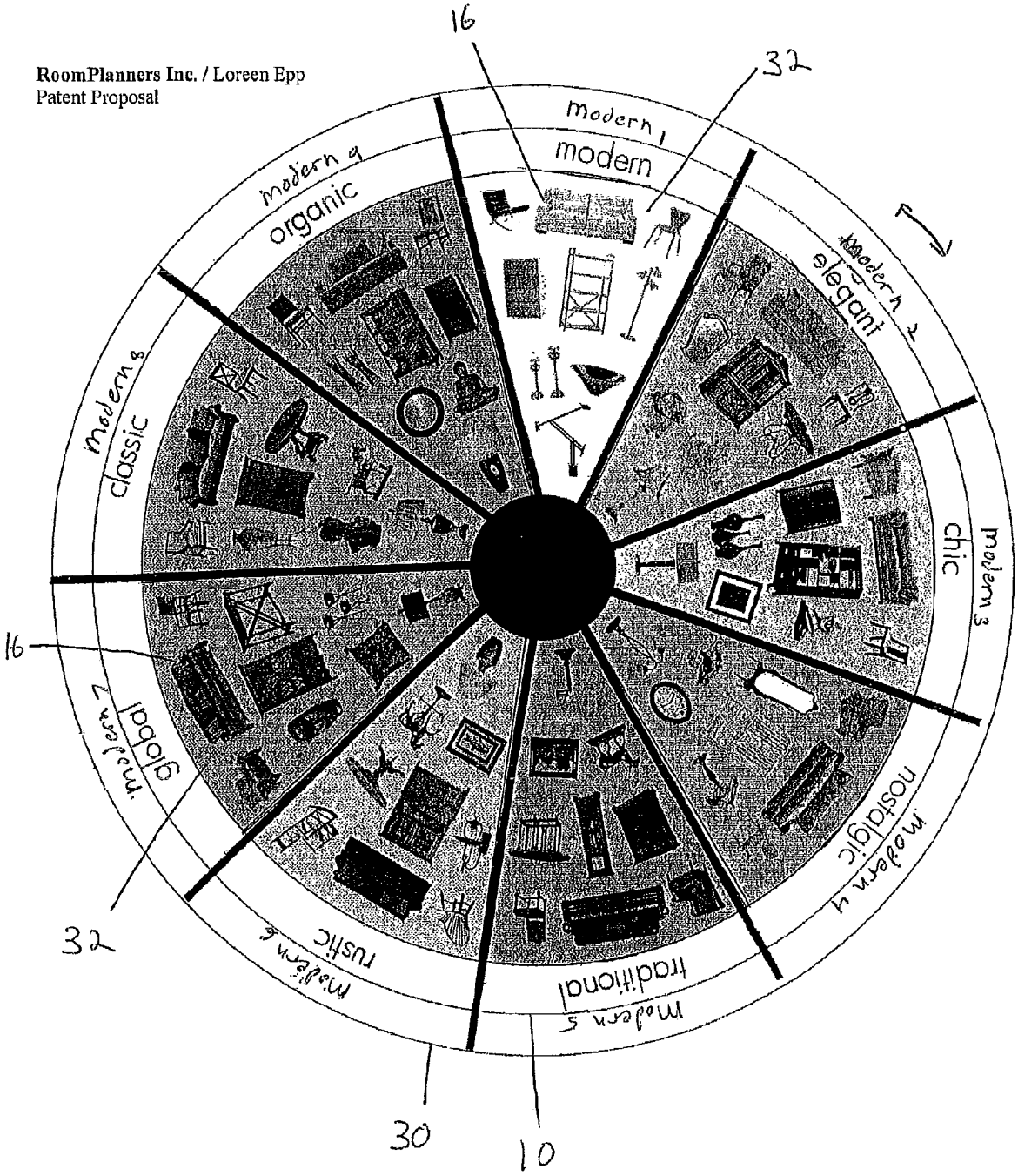
Figure 5B:
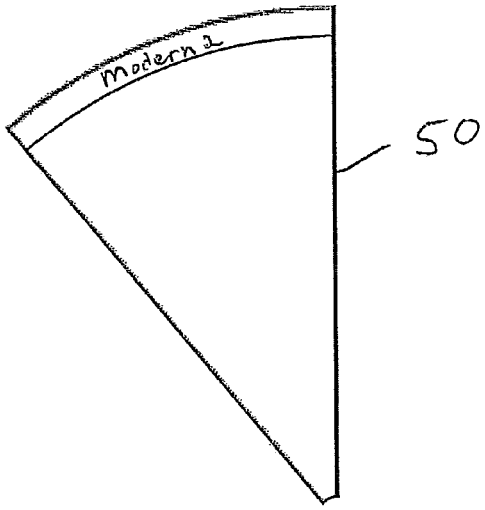

FIG. 5*a* illustrates an exemplary first selection wheel overlaying a third selection wheel;

FIG. 5*b* illustrates an exemplary a color refinement wedge; and

Figure 6:
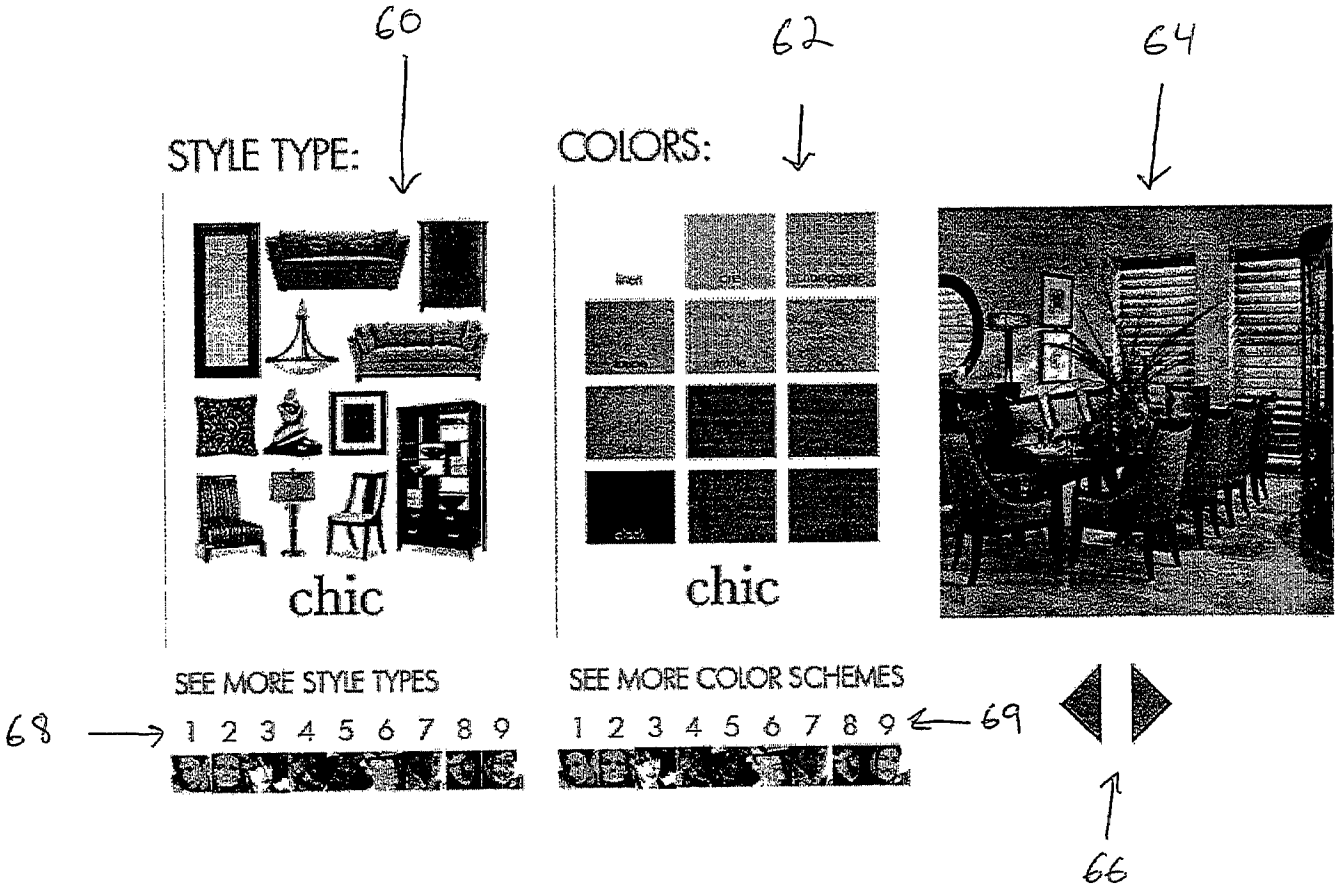

FIG. 6 illustrates an exemplary computer implement system for assisting a user to select a preferred color and design combination.

DETAILED DESCRIPTION OF CERTAIN EMBODIMENTS OF THE INVENTION

The following detailed description, which references to and incorporates the drawings, describes and illustrates one or more specific embodiments of the invention. These embodiments, offered not to limit but only to exemplify and teach the invention, are shown and described in sufficient detail to enable those skilled in the art to practice the invention. Thus, where appropriate to avoid obscuring the invention, the description may omit certain information known to those of skill in the art.

The invention is directed to systems and devices for assisting a user in making choices with respect to design and color combinations. The system includes substrates that are described as being "wheel-shaped". This is a non-limiting example and the substrates can be of various shapes and sizes, such as square, triangular, octagonal, etc. The substrates can be made of suitable materials, such as paper card stock or plastic, as non-limiting examples.

Figure 1:
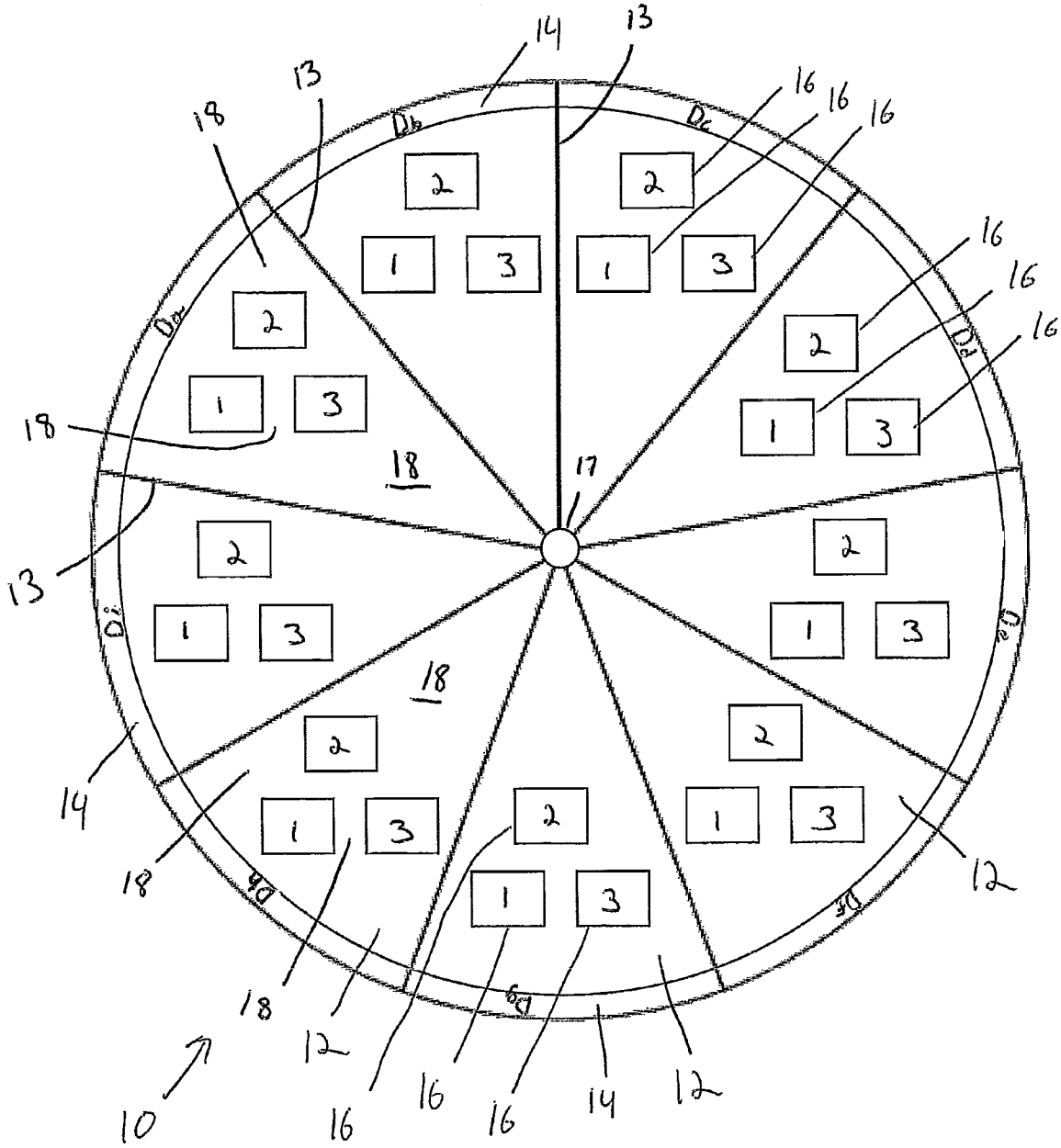
FIG. 1 illustrates an exemplary first selection wheel.

In one implementation, referring to FIG. 1, a first selection wheel 10 is shown. The first selection wheel 10 is a design selection wheel. The design selection wheel 10 can be used by a user to assist the user in selecting a style type of design items that would be used for decorating a room in a house, for example. The first selection wheel 10 includes nine different sections 12, however, the number of sections is exemplary and more or less than nine sections can be used. Visual demarcations 13 (e.g., border lines) are included to indicate the boundaries between each section. Each of the sections 12 of design selection wheel 10 is representative of a different design category. As shown in FIG. 1, each section 12 includes a label area 14. Indicia can be included in each label area 14 to identify the design category that is represented in each respective wheel section 12. As shown in FIG. 1, the indicia are represented as Da, Db, Dc, Dd, De, Df, Dg, Dh, Di. The indicia Da-Di can be representative of names of different style categories. For example, the names for the style categories can include "modern," "couture," "chic," "vintage," "traditional," "rustic," "global," "classic," and "organic." This is just an exemplary list and other names and/or more or less names could be used.

Within each section 12 are pictures and/or illustrations 16 of design items, shown in FIG. 1 as boxes 1-3. The design items in each respective section 12 are representative of the respective design style of that section. For example, box 1 in each respective section 12 can be an illustration of a couch. However, each of the couches is representative of the design style of its respective wheel section 12. For example, if section Da represented a "rustic" style, then the couch in box 1 of section Da might be a denim couch, and, if section Db represented a "modern" style, then the couch in box 1 of section Db might be a neatly upholstered couch with metal legs. Accordingly, even though the design items illustrated in like boxes are of the same type, their style is representative of the style category of the respective wheel section. A non-exclusive, non-limiting list of design items that may be illustrated on the wheel sections include room furnishing such as couches, tables, chairs, entertainment centers, cabinets, pillows, light fixtures, artwork, clocks, and other design accessory items.

The background areas 18 of each respective section 12 are transparent. That is, the area 18 between each of the visual representations 16 is transparent. Accordingly, a second selection wheel 20 can be placed behind the first selection wheel 10 and viewed through the transparent areas 18, as discussed in more detail below. In one embodiment, selection wheel 10 can be transparent plastic material and the indicia and illustrations can be printed directly on the transparent material. Alternatively, the sections of wheel 10 can include holes or windows to provide the transparent areas 18.

Figure 2:
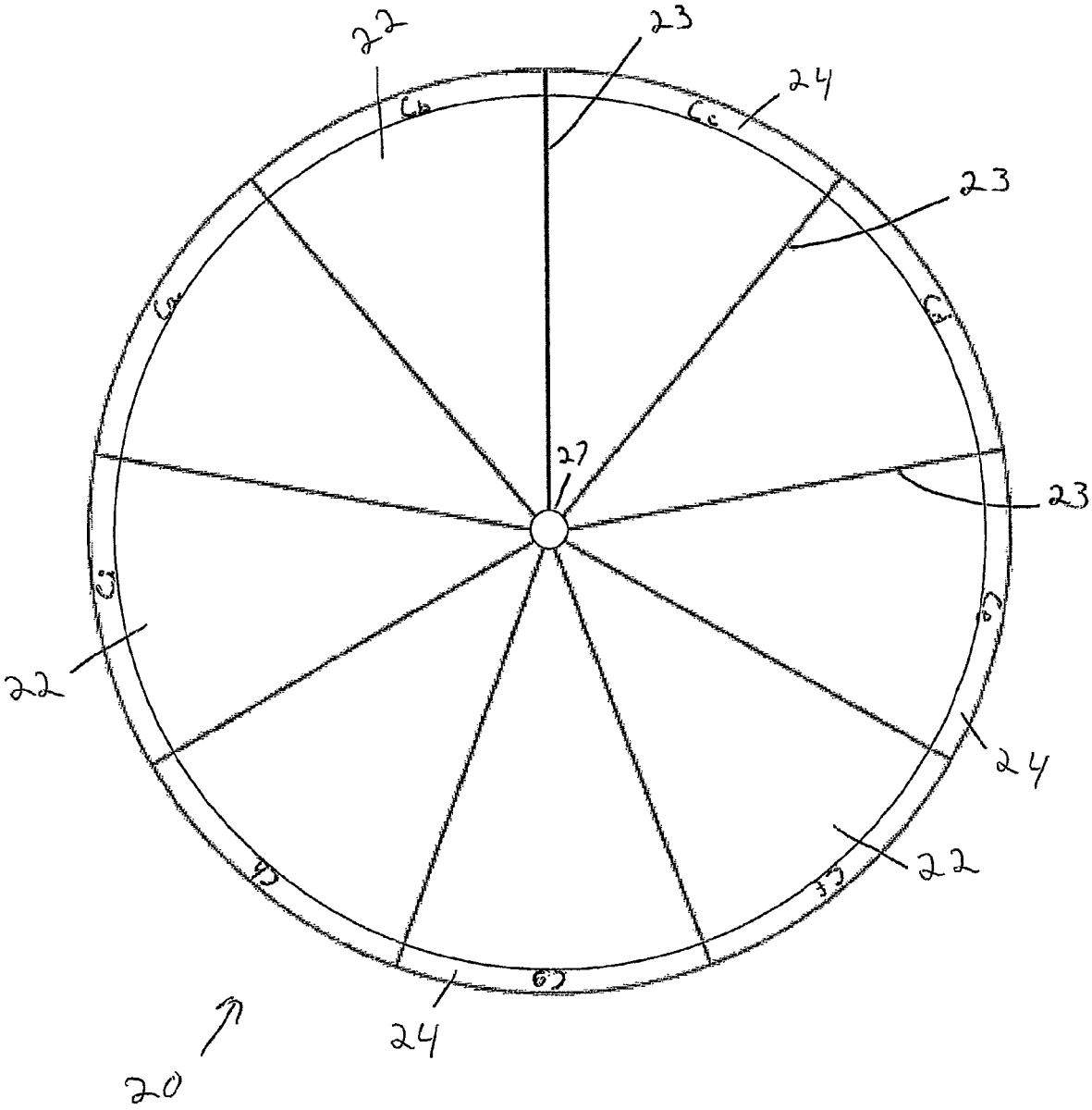
FIG. 2 illustrates an exemplary second selection wheel.

Referring to FIG. 2, a second selection wheel 20 is shown. The second selection wheel 20 is a color selection wheel. The color selection wheel 20 can be used by a user to assist the user in selecting a color style type. The second selection wheel 20 includes nine different sections 22, however, the number of sections is exemplary and more or less than nine sections can be used. Each of the sections 22 of color selection wheel 20 is representative of a different color category. Visual demarcations 23 (e.g., border lines) are included to indicate the boundaries between each section. As shown in FIG. 2, each section 22 includes a label area 24. Indicia can be included in each label area 24 to identify the color category that is represented in each respective wheel section 22. As shown in FIG. 2, the indicia are represented as Ca, Cb, Cc, Cd, Ce, Cf, Cg, Ch, Ci. The indicia Ca-Ci can be representative of names of different color categories. For example, the names for the color categories can include "modern," "couture," "chic," "vintage," "traditional," "rustic," "global," "classic," and "organic." This is just an exemplary list and other names and/or more or less names could be used. In addition, while the names of the color categories can be the same names as the design categories, it is not required.

Figure 3:
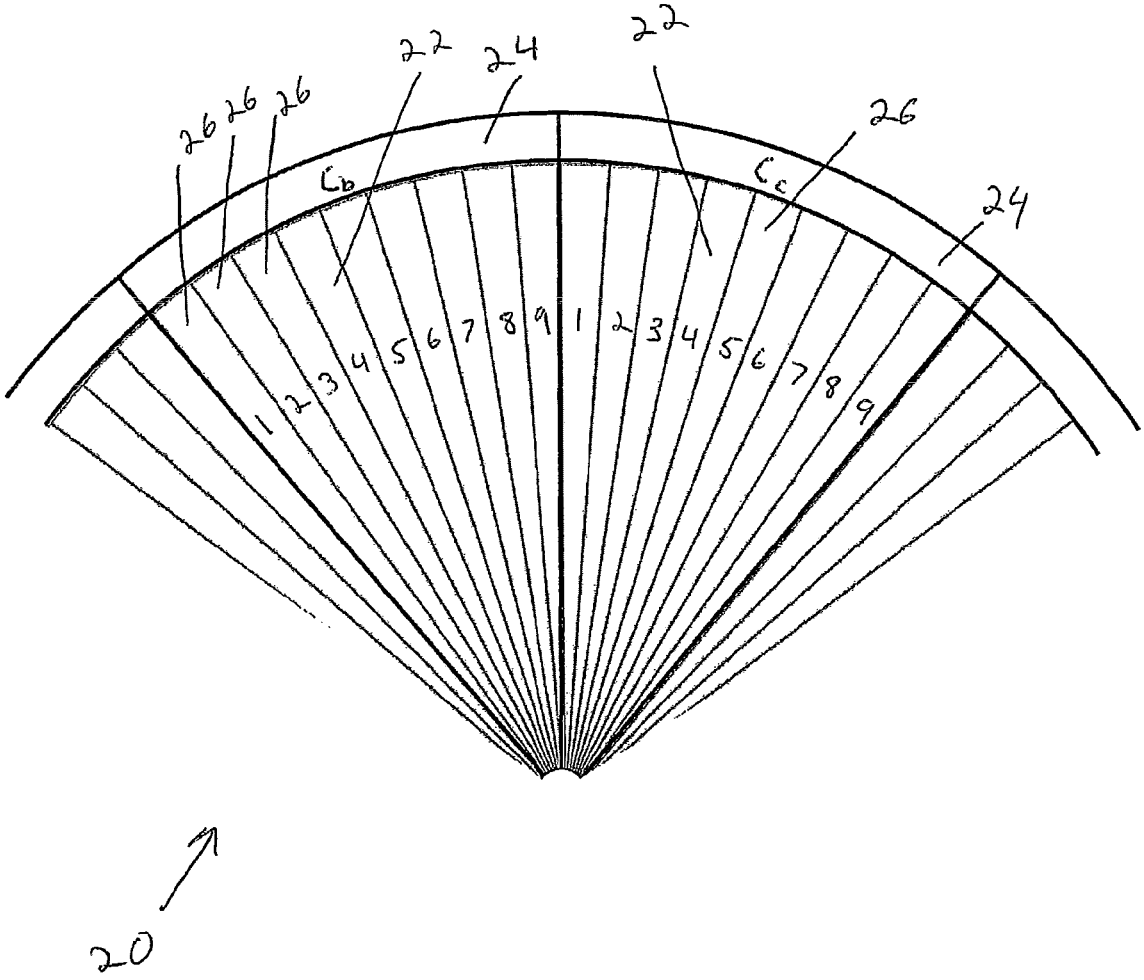
FIG. 3 is a close-up view of a section of the second selection wheel.

Referring to FIG. 3, a close-up view of a portion of color selection wheel 20 is shown. As can be seen, each section 22 includes multiple swatch areas 26 labeled 1-9. The number of color swatches illustrated is exemplary and more or less color swatch areas can be included in each section 22. For example, each section 22 can include twelve swatch areas. Each swatch area 26 is a colored a different color that is representative of the color category of the respective section 22. The swatch areas 26 in each section 22, taken together, create a color palette that is representative of the color category of the respective section 22. For example, if section Cc represented an "organic" color style, then the colors of the swatch areas of section Cc might consist of mute, earth tone colors, and, if section Cb represented a "modern" color style, then the swatch areas of section Cb might consist of bright, primary colors.

Figure 4:
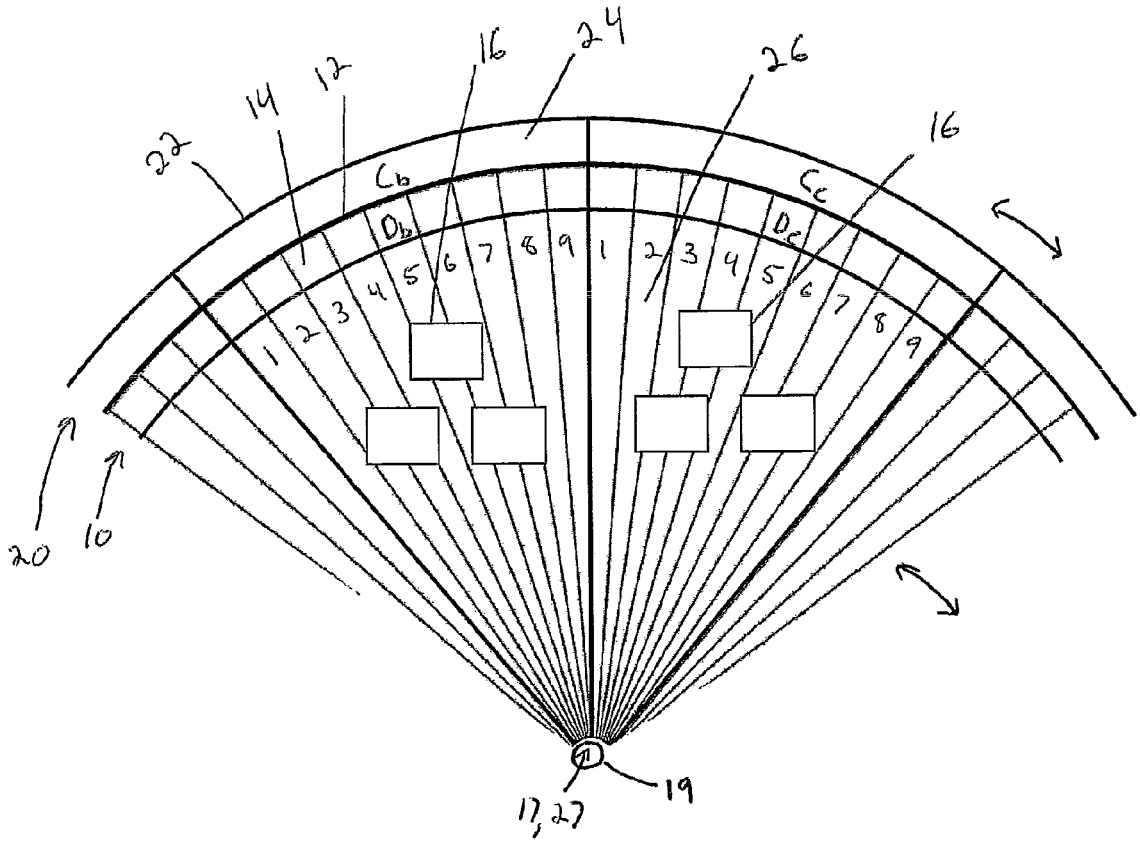
FIG. 4 is a close-up view of a section of the first selection wheel overlaying the second selection wheel.

Referring to FIG. 4, a close-up view of a portion of design selection wheel 10 overlaying color selection wheel 20 is shown. As discussed above, the background areas 18 of the design selection wheel 10 are transparent. As such, when the design selection wheel 10 is overlaying the color selection wheel 20, the colors of the color swatch areas 26 can be seen through the background areas 18. Accordingly, the user can see the illustrations of the design items 16 in relation to the colors of the color swatch areas 26.

The first and second selection wheels 10 and 20 can rotate with respect to one another. In one embodiment, the first and second wheels 10 and 20 can be supported on an axial post or pin 19 that can be disposed through holes 17, 27. The pin permits the first and second wheels to be supported in overlying relationship while permitting independent rotation of each wheel. This arrangement allows the user to view the design items that are representative of a particular design category of a respective section 12 in relation to a color palette of a particular color category of a respective section 22. For example, if section Da of the first wheel represented a "rustic" design style and section Ca of the second wheel represented a "rustic" color palette, the user could rotate the first and second wheels with respect to each other such that section Da overlaid section Ca. As such, the user could view design items representative of a "rustic" style in combination with a "rustic" color palette. If section Cb represented a "modern" color style, the user could rotate the wheels such that section Da overlaid section Cb and the user could then view "rustic" style design items in combination with a "modern" color palette.

Accordingly, a significant advantage of the present invention is that design items of particular categories can be presented to a user in combination with various color palettes of particular categories. The system allows the users to easily and quickly view different combinations by rotating the first and second wheel with respect to each other. Accordingly, the user is assisted in selecting design item styles in combination with color palette styles.

In addition, referring to FIG. 5, a third selection wheel 30 can be used to help a user further refine color selections. The third selection wheel 30 is a color refinement wheel. Preferably, the color selection system includes multiple color refinement wheels 30 that respectively correspond to each of the color categories sections 22 of the color selection wheel 20. If color selection wheel 20 included nine sections 22, then the system would include nine corresponding color refinement wheels 30, one for each of the nine sections 22. For example, if the color selection wheel 20 included nine sections 22 corresponding to the following color categories: "modern," "couture," "chic," "vintage," "traditional," "rustic," "global," "classic," and "organic", then the system would include a "modern," "couture," "chic," "vintage," "traditional," "rustic," "global," "classic," and "organic" color refinement wheel.

Each section 32 of the color refinement wheel corresponds to the colors of the color swatch areas 26 of the corresponding color category section 22 of the color selection wheel 20. For example, if section Cb of color selection wheel 20 represented a "modern" color style and included nine color swatch areas within that section, then the corresponding "modern" color refinement wheel 30 would include nine sections 32, one corresponding to each of the nine color swatch areas.

As can be seen in FIG. 5*a*, the color refinement wheel 30 is shown to have the same number of sections as the design wheel 10, i.e., nine sections. However, the color refinement wheel can have more or less sections 32 than the number of sections 12 of the design wheel 10. For example, if the number of color swatch areas 26 in each of the sections 22 of the color selection wheel 20 equaled 12, then the color refinement wheel 30 would have 12 sections. Accordingly, the relative size and shape of the sections 32 of the color refinement wheel 30 would be smaller that the sections 12 of the design wheel 10. As such, a user could position the desired color refinement section 32 in relation the desired design section 12, for example, by centering the smaller section behind the larger section. Thus, the desired color could still be viewed through the background areas 18, with sections of adjacent color sections 32 on either side.

As discussed above, the design wheel 10 and the color wheel 20 include central holes 17, 27 through which a pin can be inserted to hold the two wheels in overlying relationship. The color refinement wheel 30 also includes a central hole. Accordingly, the pin can be removed, the color refinement wheel 30 inserted between the design wheel 10 and the color wheel 20, and the pin reinserted through all three holes such that all three wheel are held in overlying relationship, while still permitting relative rotation. The color refinement wheel 30 could also include a slit extending from its outer perimeter to its mounting hole so that the color refinement wheel 30 can be inserted between the design wheel 10 and the color wheel 20 by sliding the wheel 30 such that the pin passes along the slit until the pin is located at the central mounting hole of the wheel 30.

Once a user has made an initial selection of a color category using design selection wheel 10 and color selection wheel 20, the color refinement wheel 30 corresponding to the selected color category can be inserted between the design selection wheel 10 and the color selection wheel 20. Accordingly, the design selection wheel 10 overlays the color refinement wheel 30. As such, the different design styles represented in the respective sections 12 of the design selection wheel 10 can be viewed in combination with each color of sections 32 of the color refinement wheel 30 separately. With this arrangement, the user can view the different design styles in combination with each color of the selected color style individually. By rotating the wheels 10 and 30 with respect to each other, design styles can be view in combination with individual colors of a selected color category. This will assist the user in selecting specific colors from the selected color category and will help the user confirm that the user has made an aesthetically pleasing color category selection. Referring to FIG. 5*a*, for example, a design selection wheel 10 is shown in combination a color refinement wheel 30 representing the colors of the "modern" color palette. As can be seen, the sections 32 of wheel 30 are labeled modern1-modern9 because each section 32 of wheel 30 corresponds to the colors of the color area swatches 26 labeled 1-9 of the "modern" section 22 of wheel 20.

If the user, after viewing the colors individually using the color refinement wheel 30, decides that he or she is unsure of the initial color category selection, wheel 30 can be removed and wheel 10 can viewed in combination with wheel 20 again. Once the user makes another color category selection, the color refinement wheel corresponding to that color category can be inserted between wheels 10 and 20.

In addition, the system can also include individual color panels, such as color wedge 50, as shown in FIG. 5*b*. The system would include a color wedge 50 that corresponds to each of the colors of the color swatch areas 26 on the color wheel 20. Accordingly, for example, if the color wheel 20 included nine sections 22 and each section included nine swatch areas 26, the system would include 81 color wedges. Once a user identified a desired color (as a wall paint color, for example), the corresponding color wedge can be retrieved and inserted between the design wheel 10 and the color wheel 20. The color wedge is then placed behind the selected section 12 of the design wheel 10 so that the items 16 of the selected style can be viewed in relation to the selected color of the color wedge.

Accordingly, certain advantages of the invention allow users to view colors that are grouped into categories in combination with design styles. The user can see colors that are grouped according to a particular category, in which brightness, hue, and or other characteristics that are similar across the grouped colors. Thus, the user can use the invention to make a selection of a preferred color category by viewing multiple grouping of colors of different categories. In addition, the user can view the color groups in connection with physical design items (e.g., room furnishing such as furniture, lamps, rugs, and other decorating accessories) so that design styles can be selected in combination with colors. Thus, the system allows a user to pick both design elements and color elements to, for example, design a room in a house. The user can pick colors for the selected color grouping for use on walls or window coverings, for example, and pick furnishing styles to furnish the room with, for example.

In other aspects, a computer implemented system can be used to assist a user in making a selection of a design category in combination with a color category. The computer system can present the user with a number of different queries design to illicit information that is indicative of a user's design and color preferences. The system collects user responses and analyzes the responses in order to determine the user's preferences. The strength of the user's preferences are then ranked and ordered. Once the system makes a determination of the user's strongest preferences, the system presents design items representative of that design category, a color palette representative of that color category, and optionally, a room scene that includes design items of that category in combination with colors of that category. Referring to FIG. 6, based on the analysis of the collected user information, the most preferred design type 60 is presented alongside the most preferred color type 62 and further alongside a room scene 64 showing the design type 60 in combination with color type 62. Selector buttons 66 can be used to switch between design type and color type combinations simultaneously. Accordingly, if the user is presented with the most preferred design type in combination with the most preferred color type, by clicking the right arrow selector button 66, the user is presented with the second most preferred design type in combination with the second most preferred color type. In addition, individual sector buttons 68 and 69 can be used to switch between design types and color types individually. Accordingly, a user can view the most preferred design type in combination with the second most preferred color type by manipulating selector buttons 68 and 69, for example.

The subject matter described above is provided by way of illustration only and should not be construed as limiting. Various modifications and changes can be made to the subject matter described herein without following the example embodiments and applications illustrated and described, and without departing from the true spirit and scope of the present invention, which is set forth in the following claims.

I claim:

1. A system for presenting color and design combinations, comprising:

a first substrate having at least two sections, each first substrate section including at least one transparent area and visual representations of physical items representative of a particular style category, wherein the style category of each first substrate section differs from the style category of another first substrate section;

a second substrate having at least two sections, each second substrate section including at least two colors representative of a particular color category, wherein the color category of each second substrate section differs from the color category of another second substrate section;

a support that maintains the first and second substrate in spatial relationship with the first substrate overlying the second substrate;

wherein the first and second substrates are movably positionable with respect to each other from a first position in which one of the second substrate sections can be viewed through the transparent area of one of the first substrate sections and second position in which a different one of the second substrate sections can be viewed through the transparent area of the same one of the first substrate sections.

2. The system of claim 1, further comprising:

a third substrate having a number of sections equal to the number of colors in each of the second substrate sections, each third substrate section including a single color that is the same color as a respective color of one of the second substrate sections such that a single third substrate includes all the colors of a single second substrate section, wherein the third substrate is interposed between the first and second substrates.

3. The system of claim 1, wherein the first and second substrates are wheel shaped.

4. The system of claim 1, wherein the physical items are room furnishings.

5. The system of claim 1, wherein the style categories of the first substrate correspond to the color categories of the second substrate.

6. The system of claim 1, wherein first substrate includes indicia to identify the style category of each of the first substrate sections.

7. The system of claim 1, wherein second substrate includes indicia to identify the color category of each of the second substrate sections.

8. The system of claim 1, wherein visual demarcations separate the sections of each of the first and second substrates.

9. The system of claim 1, further comprising:

a color panel having a color that is the same as one of the colors of the second substrate wherein the color panel is interposed between the first and second substrates.

* * * * *